US007503261B2

(12) United States Patent
Burri

(10) Patent No.: US 7,503,261 B2
(45) Date of Patent: Mar. 17, 2009

(54) UNIVERSAL KE PROJECTILE, IN PARTICULAR FOR MEDIUM CALIBER MUNITIONS

(75) Inventor: Jakob Burri, Regensdorf (CH)

(73) Assignee: Oerlikon Cantraves Pyrotec AG, Zurich (CH)

( * ) Notice: Subject to any disclaimer, the term of this patent is extended or adjusted under 35 U.S.C. 154(b) by 22 days.

(21) Appl. No.: 11/007,419

(22) Filed: Dec. 8, 2004

(65) Prior Publication Data

US 2006/0054047 A1 Mar. 16, 2006

Related U.S. Application Data

(60) Provisional application No. 60/557,310, filed on Mar. 29, 2004.

(30) Foreign Application Priority Data

Jan. 30, 2004 (DE) ..... 10 2004 005 042

(51) Int. Cl.
*F42B 12/58* (2006.01)

(52) U.S. Cl. ..... 102/518; 102/504

(58) Field of Classification Search ..... 102/504, 102/510, 516, 517, 518, 519
See application file for complete search history.

(56) References Cited

U.S. PATENT DOCUMENTS 3,698,322 A * 10/1972 Miller ..... 102/473
3,724,386 A * 4/1973 Schmidt ..... 244/159.1
4,080,900 A 3/1978 Augenstein et al.
4,430,941 A * 2/1984 Raech et al. ..... 102/496
4,649,829 A * 3/1987 Bilsbury ..... 102/515
4,724,769 A * 2/1988 Luther et al. ..... 102/518
5,025,730 A * 6/1991 Petrovich ..... 102/516
5,325,787 A 7/1994 Boual
5,442,989 A 8/1995 Anderson
5,535,679 A * 7/1996 Craddock ..... 102/494
6,119,600 A * 9/2000 Burri ..... 102/518
6,367,388 B1 * 4/2002 Billings ..... 102/454
6,799,518 B1 * 10/2004 Williams ..... 102/513

FOREIGN PATENT DOCUMENTS

DE PS 4392 7/1892
DE 40 16 051 A1 11/1991
DE 40 24 543 A1 2/1992
DE 36 17 415 A1 5/1992

(Continued)

OTHER PUBLICATIONS www.wehrtechnik.net/Wehrtechnik/frap.html, Neue 27 mm Bordmunition, 7 pages, Jan. 26, 2004.

(Continued)

*Primary Examiner*—Stephen M Johnson
(74) *Attorney, Agent, or Firm*—McCormick Paulding & Huber LLP

(57) ABSTRACT

It is proposed to combine the cascade effect of frangible pellets with sub-projectiles made of ductile heavy metal, that is, to produce a munition in which the advantages of for example frangible pellets of a central penetrator are combined with the advantages of the ductile heavy metal in an external penetrator\whereby an improved performance on various targets is achieved along with deeper impact speeds.

19 Claims, 2 Drawing Sheets

FOREIGN PATENT DOCUMENTS

| | | | |
|---|---|---|---|
| EP | 0 853 228 | A1 | 7/1998 |
| EP | 0 989 381 | B1 | 9/2001 |
| FR | 2 629 581 | | 12/1976 |
| FR | 2 526 152 | | 11/1983 |
| FR | 2 529 663 | * | 1/1984 |
| FR | 2 673 461 | | 9/2002 |
| GB | 2 251 480 | A | 7/1992 |

OTHER PUBLICATIONS www.dtic.mil/ndia/2002gun/buckley.pdf; Fragmentation Payload Ammunition Frap; 21 pages; 2002.
US 4,671,989, 06/1987, Wallow et al. (withdrawn)

* cited by examiner

UNIVERSAL KE PROJECTILE, IN PARTICULAR FOR MEDIUM CALIBER MUNITIONS

CROSS REFERENCE TO RELATED APPLICATIONS

The priority of German Patent Application DE 10 2004 005 042.2 filed Jan. 30, 2004 and U.S. Provisional Patent Application 60/557,310, filed on Mar. 29, 2004, and the disclosure of both the German and U.S. Provisional Patent Applications are incorporated by reference.

FIELD OF THE INVENTION

The invention relates to a universal-KE (kinetic energy) projectile, a method for manufacturing the projectile as well as its application.

BACKGROUND OF THE INVENTION

Known types of munitions frequently do not have a penetrating effect against modern targets such that the munition type is in a position to claim that it can bring a large destructive power to a target. This power is achieved by means of a large splintering effect in radial directions as well as in the direction of the target. Furthermore, the destructive power is aided additionally by the associated blast.

A conventional projectile as well as its method of manufacture is known from EP 0 853 228 B1. With this method projectiles can be manufactured simply and in a timely manner with one or more multiple projectile bodies (penetrator or, correspondingly, penetrator parts) in various shapes and sizes. The shell of the projectile consists of projectile tip firmly connected with a sleeve which inside has a centering device in which the projectile body is guided and held. The backside of the projectile sleeve is enclosed with a sealing body partially surrounding the projectile body. With these projectiles, known as full caliber KE projectiles, the projectile sleeves as well as the projectile rear ends are frequently made of aluminum; however, steel can also be substituted. The ballistic projectile tip is likewise made of aluminum; however, it can also be made of plastic.

Projectiles known as FAP (frangible armor piercing) projectiles are effective against various targets because of their kinetic energy. These projectiles have a core made of a frangible material which according to EP 0 853 228 B1 can be assembled from various frangible pellets. As the basic material for these partial projectile bodies, frangible as well as ductile heavy metal is recommended. The core is, for example, surrounded by injection molded plastic.

Also with a FAP projectiles it is generally known that the destructive power on the target depends upon the impact speed. Accordingly, first of all the projectile tip or correspondingly projectile sleeve must break up in order that the frangible core can be effective. The breaking up of the frangible core also requires energy. With higher impact speeds, (for example with large shooting distances) the energy is frequently too low in order to sufficiently bring about fragmentation. This has the consequence that the effective spreading on the target is smaller. Furthermore, a core of this type has the property that it breaks up into multiple splinters in tests on scale targets simulating various targets. These splinters further break up the adjacent plates and so on, which one calls the cascade effect. These splinters can be so small that their energy is no longer sufficient to penetrate the next plate. That is, after a few plates (in greater target depths) the desired spreading effects overlap.

At the Internet address http://www:wehrtechnik.net/wehrtechnik/frap.html various preferences for a FRAP (fragmenting payload) can be seen. These munition types known as shipboard munitions have among other things no hollow shell contents and no impact detonators. A closer embodiment to the FRAP-munition and the previously mentioned pre-fragmenting WOLFRAM effective mass can be gathered from the article "Fragmenting Payload Ammunition Frap" of Allan Buckley & Pierre H. Freymond at the NDIA 37$^{th}$ Gun and Ammo Symposium of 15-18 Apr. 2002 held in Panama City <http://www.tdic.mil/ndia/2002gun/buckely.pdf>.

The invention has as its object increasing the spreading effect at the target. Additionally it is intended to produce the greatest possible penetrating power in a mono-block target.

This object is achieved through a unique universal KE projectile, a method for manufacturing a projectile and use of the projectile as a munition.

The invention has as its basic idea to combine the spreading effect of the frangible pellets with sub-projectiles made of a ductile heavy metal, that is, to produce a munition in which the advantages of a central penetrator consisting of for example frangible pellets are combined with the advantages of ductile heavy metals of an exterior penetrator. The ductile heavy metal has as a property that it does not break up at the target plate so that it forms a good splitter cone.

A shell penetrator for a KE projectile is known from DE 40 16 051 C2 which as a ductile jacket protects the pressure sensitive penetrator and which makes possible, and whose final assembly to the penetrator makes possible, cost effective batch production. In contrast to this the preferably curved shape design of the external penetrator formed from individual sub-projectiles here produces a buckling effect so that the penetrator shell located around the exterior penetrator is immediately torn apart and the ductile sub-projectiles are set free. These sub-projectiles are fixedly mounted in an injected plastic in the external penetrator which has the advantage that the projectile sleeve surrounding the penetrator can be designed to be very thin. This thin shell produces a simple hole in the target.

The central-penetrator of frangible pellets is effective in a mono-block target. This makes it possible to use this projectile as a universal substitute. This therefore accomplishes a FAP projectile with a FRAP fragmenting payload concept.

BRIEF DESCRIPTION OF THE DRAWINGS

With the exemplary example, the invention is further described in the drawings which show:

FIG. 1 shows a munition 10 which consists essentially of a projectile 1, a guide ring 2, grooving 3, a cartridge sleeve 4 and a propellant charge 5.

FIG. 2 illustrates these parts in section for closer observation of the projectile such that FIG. 2 comprises a first embodiment.

DESCRIPTION OF THE PREFERRED EMBODIMENTS

Figure 1:
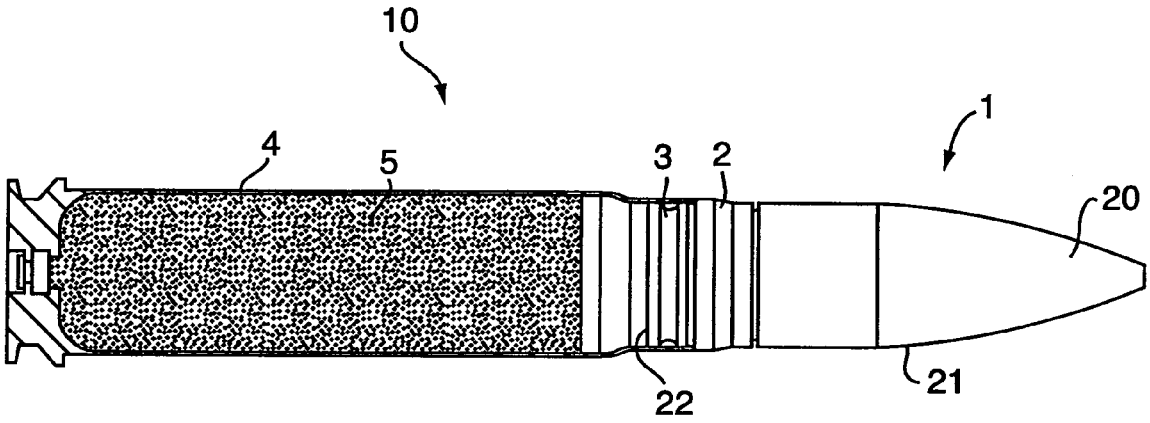
FIG. 1—a complete munition partially in section.
Figure 2A:
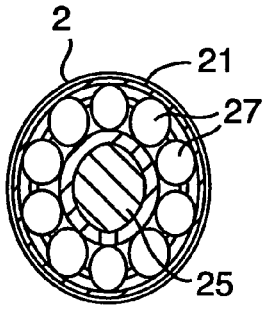
FIGS. 2A, 3A, and 4A are cross-sectional representations of FIGS. 2, 3, and 4.
Figure 2:
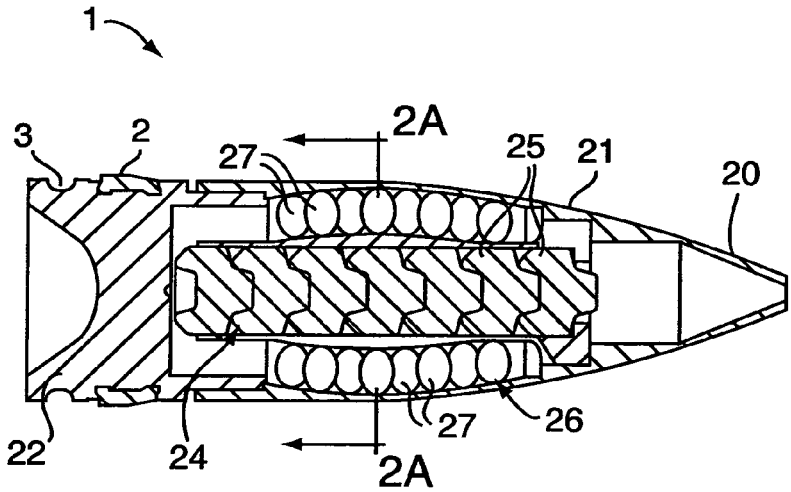
FIG. 2.—a sectional view of the front part of the projectile in FIG. 1.
Figure 3A:
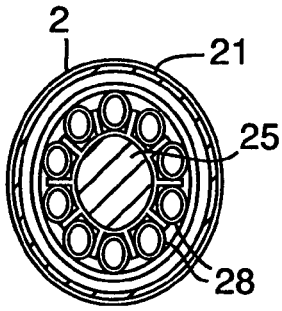
Figure 3:
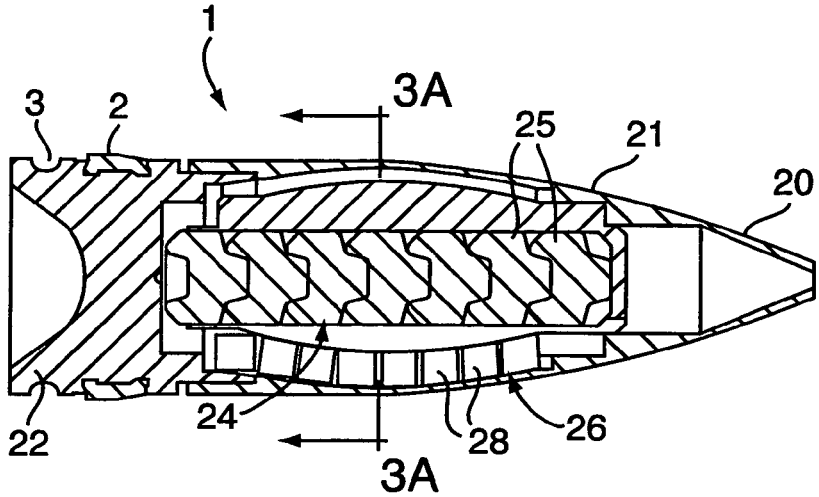
FIG. 3.—a variation of the sectional view of the front part in FIG. 1.
Figure 4A:
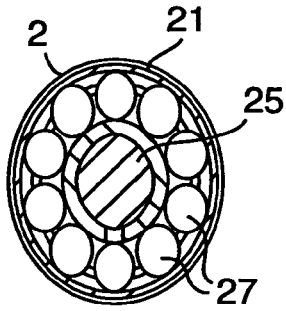
Figure 4:
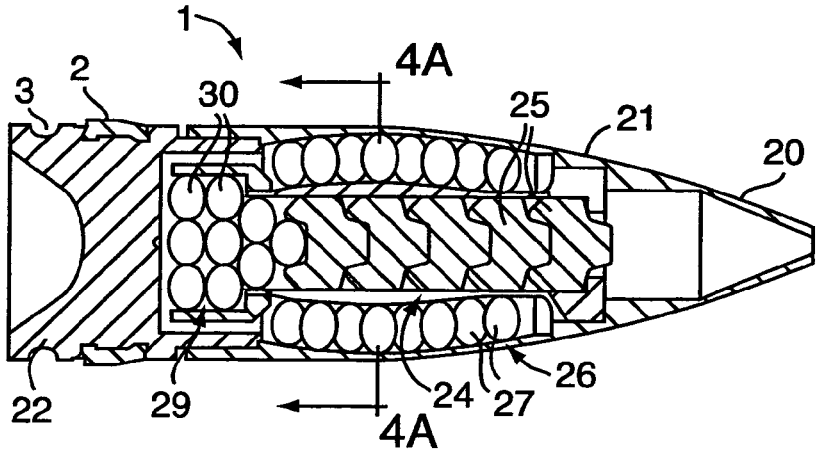
FIG. 4.—a further variation of FIG. 1.

The projectile 1, a universal (multi-purpose) KE projectile, is formed with a projectile tip 20, a projectile sleeve 21 as well as a tail end 22. A central penetrator designated 24, which is preferably composed of frangible pellets 25, can also be a single piece, and in many cases also can be designated as the projectile core. An external penetrator designated 26 consists of a ball-shaped 27, possibly also cylinder-shaped 28 (cylindrical or the like and/or cube-shaped and/or block like) ductile heavy metal (FIG. 3) which here is designated as sub-projectiles 27, 28. A final penetrator 29, preferably the end of the frangible central penetrator 24, consists in one further variant accordingly to FIG. 4 likewise of ball shaped or cylinder shaped ductile heavy metal 30 which also is designated as a sub-projectile.

The exterior projectile 26 preferably has in all embodiments a curve shape or correspondingly a banana shape or design in order to preferably accomplish a buckling effect so that the projectile shell 21 breaks apart and the sub-projectiles 27 and 28 are set free. With the impact of the munition 10 on a target (that is not further illustrated) the projectile sleeve 21 next to the projectile tip 20 and supported from the external penetrator 26 is also destroyed. The freely released sub-projectiles 27, 28 aid on the one hand the central penetrator 24 or the pellets 25 in penetrating the target. A further improvement in addition can be accomplished through the insertion of the final penetrator 29. Here the sub-projectiles 30 also have a supporting effect.

The projectile tip 20 as well as the projectile shell 21 can be comprised of aluminum. Alternatively, the possibilities are also offered that the projectile tip 20 can be formed of an injected material, for example, plastic. This plastic can preferably be a fiber reinforced thermal plastic material. The same is true for the projectile shell 21 which likewise can be formed of plastic whereby here also a combination of plastic and steel can be offered.

In order to maintain the tolerances with the mounting of the projectile 1 and to hold the sub-projectiles 27, 28 from the outside, a plastic can be injected in preferred variations of the projectile shell 21. The plastic can also be injected from the backside. These variations require for example only a small hole, preferably centrally in the rear region. The use of plastic makes possible the use of a very thin projectile shell 21. The process associated with it is simple and makes possible an economic fabrication.

What is claimed:

1. A universal KE-projectile comprising:

a projectile tip;

a projectile sleeve;

a projectile tail end including a central penetrator assembled from frangible pellets;

an exterior penetrator having a curved or banana shape, the exterior penetrator being connected around the central penetrator and containing a plurality of ball-shaped metal and/or a plurality of cylindrical-shaped metal and/or a plurality of cube-shaped metal and/or a plurality of block shaped metal.

2. A universal KE-projectile according to claim 1, wherein the projectile tip as well as the exterior penetrator and the projectile sleeve encircling the central penetrator are aluminum.

3. A universal KE-projectile according to claim 1, wherein the projectile tip is formed from injected or injectable material including plastic.

4. A universal KE-projectile according to claim 3, wherein the plastic is a fiber reinforced thermal plastic.

5. A universal KE-projectile according to claim 1, wherein the exterior penetrator and a projectile shell encircling the central penetrator are plastic or a combination of plastic and steel or aluminum.

6. A universal KE-projectile according to claim 5, wherein the plastic is a fiber reinforced thermal plastic.

7. A universal KE-projectile according claim 1, wherein the metal is fixed in the external penetrator by means of plastic.

8. A method for manufacturing a projectile according claim 1 with the following steps;

centering the central penetrator with or without an end penetrator and its sub-projectiles, connecting the external penetrator with the sub-projectiles around the central penetrator, fixing the sub-projectiles of the external penetrator by means of plastic, and producing a projectile sleeve which at least in the external penetrator region is thin.

9. A method according to claim 8 characterized in that the plastic for fixing the sub-projectiles in the exterior penetrator is injected from the projectile tip.

10. A method according to claim 8 characterized in that the plastic is also injected from the tail side.

11. Use of the projectile of claim 1 in a munition.

12. A universal KE-projectile comprising:

a projectile tip;

a projectile sleeve;

a projectile tail end including a central penetrator;

an exterior penetrator having a curved or banana shape, the exterior penetrator being connected around the central penetrator and containing a plurality of ball-shaped metal and/or a plurality of cylindrical-shaped metal and/or a plurality of cube-shaped metal and/or a plurality of block shaped metal; and a final penetrator at a rear part of the central penetrator including a ball-shaped metal and/or cylinder-shaped metal.

13. A universal KE-projectile according to claim 12, wherein the projectile tip as well as the exterior penetrator and the projectile sleeve encircling the central penetrator are aluminum.

14. A universal KE-projectile according to claim 12, wherein the projectile tip is formed from injected or injectable material including plastic.

15. A universal KE-projectile according to claim 14, wherein the plastic is a fiber reinforced thermal plastic.

16. A universal KE-projectile according to claim 12, wherein the exterior penetrator and a projectile shell encircling the central penetrator are plastic or a combination of plastic and steel or aluminum.

17. A universal KE-projectile according to claim 16, wherein the plastic is a fiber reinforced thermal plastic.

18. A universal KE-projectile according claim 12, wherein the metal is fixed in the external penetrator by means of plastic.

19. Use of the projectile of claim 12 in a munition.

* * * * *

UNITED STATES PATENT AND TRADEMARK OFFICE

CERTIFICATE OF CORRECTION

PATENT NO. : 7,503,261 B2
APPLICATION NO. : 11/007419
DATED : March 17, 2009
INVENTOR(S) : Jakob Burri It is certified that error appears in the above-identified patent and that said Letters Patent is hereby corrected as shown below:

Title Page, Item (73) Assignee: should read as follows:

--Oerlikon Contraves Pyrotec AG,
Zurich (CH)--.

Signed and Sealed this

Twenty-third Day of June, 2009

JOHN DOLL
*Acting Director of the United States Patent and Trademark Office*